United States Patent [19]

Vogt, Jr. et al.

[11] Patent Number: 5,072,990

[45] Date of Patent: Dec. 17, 1991

[54] ACCELERATION OF HYDROCARBON GAS PRODUCTION FROM COAL BEDS

[75] Inventors: Thomas C. Vogt, Jr., Littleton; Gerard R. Obluda, Golden, both of Colo.

[73] Assignee: Mobil Oil Corporation, Fairfax, Va.

[21] Appl. No.: 551,340

[22] Filed: Jul. 12, 1990

[51] Int. Cl.[5] ..... E21B 43/24

[52] U.S. Cl. ..... 299/4; 166/272

[58] Field of Search ..... 166/272, 303; 299/4

[56] References Cited

U.S. PATENT DOCUMENTS

| | | | |
|---|---|---|---|
| 2,593,477 | 4/1952 | Newman et al. | 299/4 X |
| 2,896,932 | 7/1959 | Marquis | 299/4 X |
| 2,952,450 | 9/1960 | Purre | 299/4 |
| 4,026,359 | 5/1977 | Closmann | 299/4 X |
| 4,883,122 | 11/1989 | Puri et al. | 166/272 X |

*Primary Examiner*—William P. Neuder

*Attorney, Agent, or Firm*—Alexander J. McKillop; Charles J. Speciale; Charles A. Malone

[57] ABSTRACT

A hot fluid is injected through an injection well into a coal seam to induce more rapid and complete desorption of methane therefrom and to cause desorbed methane to proceed toward a nearby production well in the coal seam.

15 Claims, 1 Drawing Sheet

ACCELERATION OF HYDROCARBON GAS PRODUCTION FROM COAL BEDS

This invention relates to the recovery of light hydrocarbon gases from coal beds. It more particularly refers to means to stimulate and accelerate the production of such gas.

BACKGROUND OF THE INVENTION

It is well known that coal seams have methane, and other light hydrocarbon gases absorbed thereon and contained in the interstices thereof. These gases have been known to explode and cause great disasters during underground mining operations. Efforts have been made to produce the light gases from coal seams in the same manner as hydrocarbonaceous gas would be produced from any other formation. That is, a gas production well is drilled into the coal seam; as part of the well completion procedure, the seam is hydraulically fractured; the water, which usually substantially floods coal seams, is extracted; and, as the pressure in the coal seam subsides by reason of the removal of the water, the light gas is produced.

Methane is currently being produced from unconventional sources, such as coal beds, in the western and southwestern parts of the United States. This is being accomplished by conventional gas well drilling and completion procedures, as aforesaid, including hydraulic fracturing. Because the coal beds contain large quantities of water, the water must be pumped off until the reservoir pressure in the vicinity of the wellbore decreases sufficiently for the methane and other light gases to desorb from the coal surfaces and flow through the natural channels in the coal seam, as well as through fractures induced hydraulically in the seam.

It would, of course, be desirable to improve the efficiency of production of hydrocarbonaceous gas, and it is an important object of this invention to do so.

It is another important object of this invention to increase the amount of hydrocarbonaceous gas produced from coal seams as well as to reduce the time from well completion to the onset of gas production.

An additional object of this invention is to provide means to render coal mining safer, with respect to the danger of fire and explosion caused by the existence of hydrocarbonaceous gases interspersed with the coal.

SUMMARY OF THE INVENTION

According to one aspect of this invention, the production of methane and other light hydrocarbonaceous gases from coal seams is improved by drilling one or more second, injection, wells nearby the production well, into the same coal seam, or into a stratum below it, and injecting hot fluid means into the second well of a kind and to an extent sufficient to heat the coal seam and induce more rapid and more complete desorption of methane therefrom, and to cause such desorbed methane to proceed toward the first, production well and to therefore be produced from that first well. According to this invention, the second well may be drilled into the producing coal seam or into a stratum below the producing coal seam, depending upon the natural or induced flow of fluids in the ground in that area.

BRIEF DESCRIPTION OF THE DRAWING

This invention will be described with reference to the accompanying drawing in which.

DETAILED DESCRIPTION OF THE INVENTION

Figure 1:
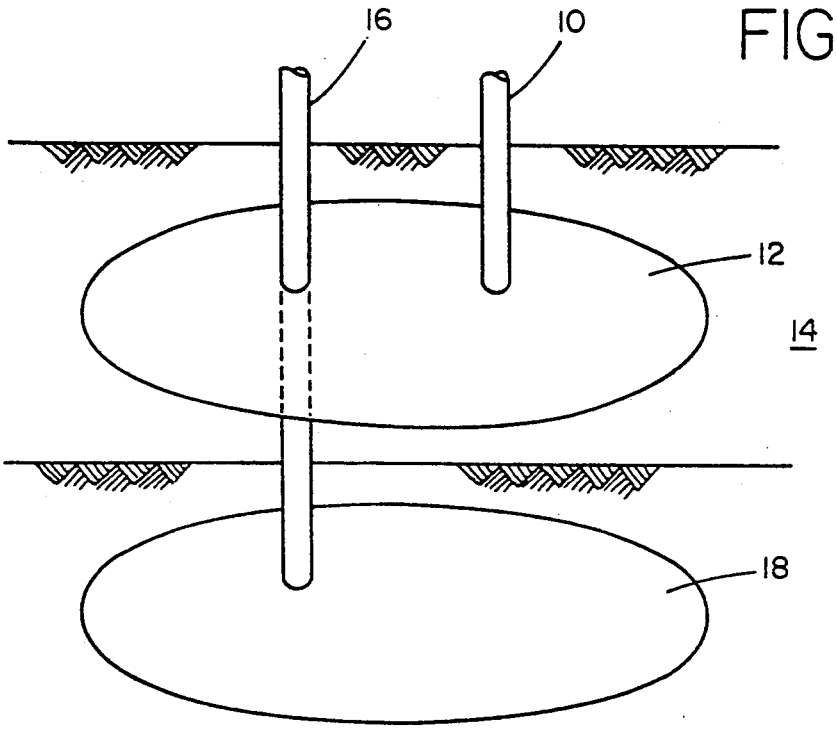
FIG. 1 is a schematic view of a pair of wells drilled into a coal seam illustrating one embodiment of this invention where horizontal fractures are induced.

The second, injection, well means may be a single well or it may be a pattern of several wells depending upon the makeup of the ground in the area being produced. Similarly, the first, or production, well means may be a single well or a pattern of several well. In fact, as with secondary recovery of crude oil, both the injection and the production well means may constitute several wells in a predetermined pattern.

It is important to the practice of this invention that the producing formation, that is the coal seam, be heated via the second, injection well. To this end, steam, hot water, or other suitable heating fluids, which are preferably not oxidizing in nature, are suitably injected into the formation through the second well means to heat the coal seam. It is possible that this heating will also effect the temperature of the surrounding, non-coal bearing, formations. This causes the methane to desorb more rapidly and more completely.

It is within the contemplation of this invention that, where the hot fluid is water, its injection temperature should be higher than the ambient temperature of the coal bearing formation. Suitably, it has not been found to be particularly advantageous to use hot water having an injection temperature higher than about 250° F. On the other hand, where steam is the hot fluid, there is substantially no limit on its temperature per se. Of course, as will be noted below, since it is not desirable for the injected fluid to have a sufficiently high pressure to fracture the formation into which it is injected, there is a functional limit on the steam temperature, which, of course is a function of its pressure. When steam is used as the injecting hot fluid, the injected gas stream should have a quality of about 60 to 70% steam.

The pressure of the injected hot fluid should suitably be higher than the ambient pressure of the coal bearing formation, in order to permit it to move into the formation. However, this pressure should be maintained at a level less than would be likely to cause the formation to fracture. Fracturing, where necessary or desired, should be accomplished separately from the heating according to this invention.

The rate at which the hot fluid is to be injected into the coal seam will of course, vary with the nature of the injecting fluid, the temperature of the injected fluid, the ambient temperature of the seam and the tenacity with which the hydrocarbonaceous gases adhere to the coal. In the common situations, using hot water at a temperature of about 180° F. as the representative example of heating fluids, the quantity of water injected will vary from about 35 to 55 barrels of water injected per day, per 10 feet of coal bed thickness, per injection well. A preferred amount will be less than about 50 barrels of water at this temperature. This is a parameter which is likely to vary from formation to formation and the numerical values set forth herein should be considered to be representative and in no way limiting on the practice of this invention. Where steam is the injected fluid, its rate of injection may be about 10 to 20 barrels per day per 10 feet of coal bed thickness. This rate will be likely to vary as a function of the steam temperature and pressure as well as the thickness of the seam into which it is being injected.

In the situation where the coal bearing formation is hydraulically fractured in order to induce better fluid flow therethrough, if the fracture is vertical in orientation, the injection well should preferably be located along a line generally perpendicular to the induced fracture which passes approximately through the producing well.

In the situation where the induced fracture is generally horizontal, the injection well should also be fractured horizontally, suitably within the coal seam if it is thick enough, but at a depth greater than the depth of the initial fracture. It is important that the lower fracture be close enough to the producing-collecting fracture within the coal seam that the added heating fluid will be able to transfer enough heat to the coal bed to cause the absorbed and trapped gases to evolve and proceed to the collecting channels. This will induce methane to travel upward toward the production well.

Referring now to the drawing, and particularly FIG. 1 thereof, there is shown a production well 10 drilled to a depth such that it becomes operatively associated with a first, generally horizontal fracture 12 which is contained within a coal seam 14. There is also provided an injection well drilled proximate to but somewhat spaced from the production well 10 which passes through the coal seam 14 and proceeds to a lower interval in the formation which has also been fractured 18. The injection well is suitably completed, according to this embodiment, in such a manner that there is not communication between it and the coal seam 14.

A heating fluid is forced down the injection well 16 in an amount and at a temperature such as to heat the coal seam 14 to an extent sufficient to force gas associated with the coal to be volatilized and mobile and to proceed toward the production well 10 from which it is produced.

Figure 2:
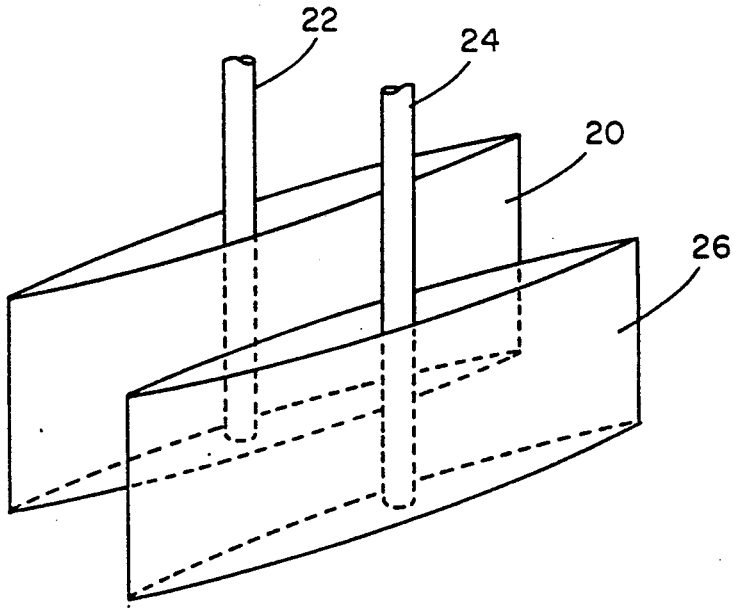
FIG. 2 is similar to FIG. 1 showing another embodiment of this invention where vertical fractures are induced.

FIG. 2 shows an embodiment of this invention in which a coal seam has been vertically fractured 20 proximate to a production well 22. An injection well 24 is drilled at a position proximate to the injection well but spaced therefrom, preferably along a line normal to the fracture 20. The formation through which the injection well has been drilled is then suitably hydraulically fractured 26, preferably along a line which is generally parallel to the production well fracture 20.

Again, a heating fluid is forced down the injection well 24 and out into its associated fracture 26 whereby heating the coal formation and forcing volatilized gas into the collecting fracture 20 and thence into the production well from which it is recovered.

What is claimed is:

1. The method for producing coal bed methane from a coal seam within a formation comprising:

(a) providing at least one completed gas production well into said seam which fluidly communicates with said seam only;

(b) completing through said coal seam at least one injection well proximate to said production well which injection well does not communicate fluidly with the coal seam but which communicates fluidly with a horizontal fracture at a lower level in the formation;

(c) injecting via said injection well a hot fluid into said horizontal fracture at a pressure less than required to fracture the formation and in a quantity sufficient to heat the coal seam thereby desorbing and volatilizing methane in said seam; and (d) producing desorbed methane from the coal seam via the production well.

2. The method as claimed in claim 1 wherein said hot fluid is water.

3. The method as claimed in claim 1 wherein said hot fluid is steam.

4. The method as claimed in claim 1 including producing at least some water contained in said coal seam prior to injecting said hot fluid.

5. The method as claimed in claim 1 including hydraulically fracturing said coal seam to an extent sufficient to facilitate the flow of desorbed methane therethrough.

6. The method as claimed in claim 1 including horizontally fracturing said coal seam.

7. The method as claimed in claim 1 including drilling a multiplicity of said injection wells.

8. The method as claimed in claim 1 including drilling a multiplicity of said production wells.

9. The method for producing coal bed methane from a coal seam within a formation comprising:

(a) fracturing hydraulically a coal seam via a completed production well in a manner sufficient to create a first vertical fracture which fluidly communicates with said seam;

(b) completing an injection well into said coal seam which well is proximate to and substantially perpendicular to the vertical fracture created via the production well;

(c) fracturing hydraulically via the injection well said coal seam thereby creating a second vertical fracture in said coal seam substantially parallel to the first fracture which second fracture communicates fluidly with said injection well thereby enabling heat to transfer from second fracture into a coal seam area containing the first fracture so as to cause desorption and volatilization of coal bed methane in that area;

(d) injecting via said injection well a hot fluid into said second fracture at a pressure less than required to fracture the formation and in a quantity sufficient to heat the coal seam thereby desorbing and volatilizing methane in said seam; and (e) producing desorbed methane from the coal seam via the production well.

10. The method as claimed in claim 9 wherein said hot fluid is water.

11. The method as claimed in claim 9 wherein said hot fluid is steam.

12. The method as claimed in claim 9 including producing at least some water contained in said coal seam prior to injecting said hot fluid.

13. The method as claimed in claim 9 wherein said injection well is drilled to a depth greater than the depth of said coal seam.

14. The method as claimed in claim 9 including drilling a multiplicity of said injection wells.

15. The method as claimed in claim 9 including drilling a multiplicity of said production wells.

* * * * *